US010786703B1

(12) United States Patent
Zimmer

(10) Patent No.: US 10,786,703 B1
(45) Date of Patent: Sep. 29, 2020

(54) CONVERTIBLE ROWING APPARATUS

(71) Applicant: John C. Zimmer, Lafayette, LA (US)

(72) Inventor: John C. Zimmer, Lafayette, LA (US)

( * ) Notice: Subject to any disclaimer, the term of this patent is extended or adjusted under 35 U.S.C. 154(b) by 77 days.

(21) Appl. No.: 16/282,904

(22) Filed: Feb. 22, 2019

Related U.S. Application Data

(60) Provisional application No. 62/633,897, filed on Feb. 22, 2018.

(51) Int. Cl.

| | |
|---|---|
| ***A63B 22/00*** | (2006.01) |
| ***A63B 21/00*** | (2006.01) |
| ***A63B 21/008*** | (2006.01) |
| ***A63B 23/035*** | (2006.01) |
| ***B63B 1/12*** | (2006.01) |
| ***B63H 16/04*** | (2006.01) |
| ***B63B 1/10*** | (2006.01) |
| ***A63B 69/06*** | (2006.01) |
| *A63B 22/20* | (2006.01) |

(52) U.S. Cl.
CPC ..... *A63B 22/0076* (2013.01); *A63B 21/0084* (2013.01); *A63B 21/153* (2013.01); *A63B 21/154* (2013.01); *A63B 23/03575* (2013.01); *A63B 69/06* (2013.01); *B63B 1/10* (2013.01); *B63B 1/121* (2013.01); *B63H 16/04* (2013.01); *A63B 21/00058* (2013.01); *A63B 21/00061* (2013.01); *A63B 22/00* (2013.01); *A63B 22/0087* (2013.01); *A63B 22/201* (2013.01); *A63B 2022/0035* (2013.01); *A63B 2022/0079* (2013.01); *A63B 2069/062* (2013.01); *A63B 2069/068* (2013.01); *A63B 2225/605* (2013.01); *B63B 2001/102* (2013.01)

(58) Field of Classification Search
CPC ... A63B 22/0076; A63B 22/20; A63B 22/201; A63B 22/203; A63B 22/208; A63B 21/0084; A63B 21/154; A63B 21/153; A63B 21/00058; A63B 21/00061; A63B 23/03575; A63B 2022/0079; A63B 2022/0087; A63B 2225/605; A63B 2225/10; A63B 2225/60; A63B 35/00; A63B 35/04; A63B 69/06; A63B 2069/062; A63B 2069/068; B63H 16/04; B63B 1/00; B63B 2001/102
See application file for complete search history.

(56) References Cited

U.S. PATENT DOCUMENTS

| | | | | |
|---|---|---|---|---|
| 4,943,051 | A * | 7/1990 | Haskins | A63B 22/0076 114/363 |
| 4,974,832 | A * | 12/1990 | Dalebout | A63B 21/00069 482/138 |
| 10,173,756 | B2 * | 1/2019 | Little | A63B 26/003 |
| 10,441,834 | B2 * | 10/2019 | Liu | A63B 21/00069 |
| 2006/0183606 | A1 * | 8/2006 | Parmater | A63B 22/0076 482/72 |
| 2018/0186441 | A1 * | 7/2018 | Schiller | B63H 25/02 |

* cited by examiner

*Primary Examiner* — Megan Anderson
(74) *Attorney, Agent, or Firm* — Jones Walker LLP

(57) ABSTRACT

A rowing machine convertible for use both indoors and outdoors. In the outdoor mode, the rowing machine is configured for adaptation to a watercraft, such as a kayak or stand up paddle board (SUP). A rower operating the rowing machine pulls on a rope or cord to cause paddles positioned at the rearward end of the machine to rotate and move the machine on a body of water. In the indoor mode, legs are attached to the machine for placement on a rigid surface. The paddles are placed in a container holding fluid.

30 Claims, 7 Drawing Sheets

CONVERTIBLE ROWING APPARATUS

CROSS-REFERENCE TO RELATED APPLICATIONS

This application claims priority to U.S. Provisional Patent Application No. 62/633,897, filed on Feb. 22, 2018, which is incorporated herein by reference.

BACKGROUND OF THE DISCLOSURE

The present disclosure relates to a convertible rowing apparatus for both indoor and outdoor use.

Indoor stationary rowing machines have become popular as a means to exercise and promote cardiovascular and muscular health and well-being. Indoor stationary rowing machines typically provide resistance through the rotation of vanes or blades either passing through water or air. The vanes/blades are typically rotated by the user pulling in a backward direction on a handle attached to a chain while sitting on a sliding chair or seat positioned on a longitudinal support member. The chain is operatively connected to means that cause rotation of the vanes/blades. The chain retracts to its starting position as the user glides forward on the seat. Indoor stationary rowing machines are not easily converted for use outdoors due to their construction and resistance mechanisms.

Kayaking and stand up paddle boarding have also become popular for recreational use and as a way to exercise outdoors on bodies of water. Kayaks and stand up paddle boards (SUP) achieve movement through the water by physical manipulation and use of a single paddle. The kayak paddle includes a pole with teardrop-shaped blades at each end. The SUP paddle includes an elongated pole with a hand grasp at one end and a teardrop-shaped blade at the other. To propel the kayak, the paddler sits in a forward-facing position holding the pole with both hands and then manipulates the paddle at an angle for insertion of one of the teardrop-shaped blades into the water with the pulling of the blade in a backward direction. The paddler would then perform the same maneuver with the other blade. To propel the SUP, the paddler stands on the board with one hand holding the hand grasp end and the other hand holding the pole at its middle section. The blade is then placed in the water and pulled in a backward direction. The paddler would then perform the same maneuver on the other side of the SUP by switching hands. Paddling a kayak or SUP does not substantially involve the use of the paddler's legs to create motion.

The paddling motion for kayaks and SUPs is distinct from the rowing motion of indoor stationary rowing machines. The rowing motion of indoor stationary rowing machines is more akin to the rowing motion associated with the rowing of a rowboat in which the user sits in a backward facing direction from the bow of the boat, holds the ends of two oars in each of the rower's hands, angles the other ends of the oars toward the bow of the boat, places the other ends of the oars in the water, and pulls the other ends of the oars towards the stern of the boat thereby causing the boat to move forward. Unfortunately, rowing a rowboat is problematic because the rower sits with his or her back to the bow and cannot readily see where the boat is headed. Also, coordinating the simultaneous rowing of two oars at one time is difficult. Rowing involves working out the whole body, including the legs.

There is a need in the exercise and outdoor sporting industries to replicate the biomechanics of human movement associated with rowing an indoor rowing machine for outdoor fitness and sport equipment.

SUMMARY OF THE INVENTION

It is an object of the present disclosure to simulate the biomechanics of human movement associated with rowing an indoor rowing machine for fitness equipment used in the outdoors.

It is also an object of the present disclosure to provide an indoor rowing machine that is convertible for outdoor use.

It is also an object of the present disclosure to provide an indoor rowing machine that is convertible for use with a watercraft.

It is also an object of the present disclosure to provide an indoor rowing machine that is convertible for use with a SUP or kayak.

It is also an object of the present disclosure to provide an indoor rowing machine that may be installed on a kayak or SUP.

These objects and others are achieved by the rowing apparatus of the present disclosure. In an embodiment, the rowing apparatus may include a longitudinal support member having a front end, a rear end, an upper side, a bottom side, a first side interconnecting the upper and bottom sides, and a second side interconnecting the upper and bottom sides. The apparatus may also include a seat operatively affixed to the longitudinal support member and configured for sliding movement along a length of the longitudinal support member. The apparatus may also include a foot rest assembly adjustably affixed to the longitudinal support member. The apparatus may also include a tubular member having first and second ends, the first end operatively affixed to the front end of the longitudinal support member, the second end terminating above the longitudinal support member. The apparatus may also include a first pulley assembly operatively connected to the rear end of the longitudinal support member. The apparatus may also include a second pulley assembly operatively connected by a second pulley frame assembly to the rear end of the longitudinal support member. The apparatus may also include a paddle assembly rotationally positioned on a shaft and operatively associated with the second pulley assembly. The apparatus may also include a pull string having a first end external to the second end of the tubular member and connected to a handle, the pull string extending through the tubular member with the second end operatively connected to the first pulley assembly. The apparatus may also include a paddle string having a first end operatively connected to the second pulley assembly and a second end operatively connected to a biasing means. The apparatus may also include one or more mounting brackets extending from the bottom side of the support member, the one or more mounting brackets configured for attachment to a watercraft for use of the apparatus on a body of water or to one or more support legs for use of the apparatus on a rigid surface.

In another embodiment of the rowing apparatus, the longitudinal support member may include one or more slots configured for attachment of items.

In yet another embodiment of the rowing apparatus, the one or more slots may extend substantially the length of the longitudinal support member.

In yet another embodiment of the rowing apparatus, the one or more slots each may have a dove-tail shape.

In yet another embodiment of the rowing apparatus, the one or more slots may comprise a first slot formed in the upper side of the longitudinal support member.

In yet another embodiment of the rowing apparatus, the one or more slots may comprise a second slot formed in the bottom side of the longitudinal support member.

In yet another embodiment of the rowing apparatus, the one or more slots may comprise a third slot formed in the first side of the longitudinal support member.

In yet another embodiment of the rowing apparatus, the one or more slots may comprise a fourth slot formed in the second side of the longitudinal support member.

In yet another embodiment of the rowing apparatus, the seat may include one or more wheels operatively associated within the one or more slots of the longitudinal support member.

In yet another embodiment of the rowing apparatus, the seat may include one or more legs extending from an underside of the seat, each of the one or more legs including a distal end, and wherein each of the one or more wheels is operatively connected to the distal end of one of the one or more legs.

In yet another embodiment of the rowing apparatus, the foot rest assembly may comprise a first platform and a second platform, wherein the one or more slots may comprise a first slot formed in the first side of the longitudinal support member and a second slot formed in the second side of the longitudinal support member, and wherein the first platform may be operatively affixed within the first slot and the second platform may be operatively affixed within the second slot.

In yet another embodiment of the rowing apparatus, the first pulley assembly may be a two-stage pulley system comprising a first pulley and a second pulley in operative arrangement, the first pulley may have a reduced diameter relative to the second pulley.

In yet another embodiment of the rowing apparatus, the second pulley assembly may be a two-stage pulley system comprising a first pulley and a second pulley in operative arrangement, the first pulley may have a reduced diameter relative to the second pulley.

In yet another embodiment of the rowing apparatus, the one or more slots may comprise a first slot formed in the upper side of the longitudinal support member, wherein the first pulley assembly may include a first pulley frame having a proximal end operatively affixed to the first pulley assembly and a distal end operatively connected within the first slot.

In yet another embodiment of the rowing apparatus, the second pulley frame assembly may comprise a first frame and a second frame, each of the first and second frames having a proximal end operatively connected to the second pulley assembly and a distal end, wherein the one or more slots may comprise a first slot formed in the first side of the longitudinal support member and a second slot formed in the second side of the longitudinal support member, and wherein the distal end of the first frame may be operatively affixed within the first slot and the distal end of the second frame is operatively affixed within the second slot.

In yet another embodiment of the rowing apparatus, the first frame may comprise a first section and a second section, the first section may have a distal end operatively affixed within the first slot and a proximal end operatively connected to a first pivoting hinge, the second section may have a proximal end operatively connected to the first pivoting hinge and a distal end operatively connected to the second pulley assembly; wherein the second frame may comprise a first section and a second section, the first section may have a distal end operatively affixed within the second slot and a proximal end operatively connected to a second pivoting hinge, the second section may have a proximal end operatively connected to the second pivoting hinge and a distal end operatively connected to the second pulley assembly.

In yet another embodiment of the rowing apparatus, the paddle assembly may include a plurality of paddle vanes.

In yet another embodiment of the rowing apparatus, the biasing means may comprise a wire spring.

In yet another embodiment of the rowing apparatus, the one or more mounting brackets may include an aperture through which a mounting strap extends for attachment of the watercraft.

In yet another embodiment of the rowing apparatus, the one or more slots may comprise a first slot formed in the bottom side of the longitudinal support member, wherein each of the one or more mounting brackets may have an upper end and a lower end, the lower end may include the aperture, the upper end may be operatively affixed within the first slot.

In yet another embodiment of the rowing apparatus, the one or more mounting brackets may comprise a first mounting bracket operatively positioned at the front end of the longitudinal support member and a second mounting bracket operatively positioned at the rear end of the longitudinal support member.

In yet another embodiment, the rowing apparatus further comprises the watercraft operatively connected to the apparatus via a securing of a first mounting strap wrapped around the watercraft and extending through the aperture of the first mounting bracket and of a second mounting strap wrapped around the watercraft and extending through the aperture of the second mounting bracket.

In yet another embodiment of the rowing apparatus, the one or more mounting brackets may comprise first and second mounting brackets each configured as a cross brace, the first cross brace may be operatively positioned at the front end of the longitudinal support member and the second cross brace may be operatively positioned at the rear end of the longitudinal support member, each of the first and second cross braces may include one or more recesses configured for placement of an upper end of a leg.

In yet another embodiment, the rowing apparatus may further comprise one or more support legs having an upper end and a lower end, the upper end of each of the one or more support legs may be received within one of the one or more recesses of the first and second cross braces, and the lower end of each of the one or more support legs may be supported by the rigid surface.

In yet another embodiment, the rowing apparatus may further comprise a container having an interior, the interior filled with a fluid, wherein the paddle assembly may be operatively positioned within the interior of the container.

In yet another embodiment of the rowing apparatus, the container may have a removable lid.

In yet another embodiment of the rowing apparatus, the apparatus further comprises one or more pontoon assemblies detachably connected to the longitudinal support member on either or both of the first and second sides thereof.

In yet another embodiment of the rowing apparatus, the paddle assembly comprises a plurality of interchangeable paddle vanes. The size and/or shape of the plurality of paddle vanes that are used with the rowing apparatus results in a variable resistance when the plurality of paddle vanes are rotated in the fluid.

In yet another embodiment of the rowing apparatus, the amount of fluid within the interior of the container when the apparatus is configured for indoor use provides a variable resistance to the paddle assembly when rotated.

In yet another embodiment of the rowing apparatus, the apparatus further comprises a shaft and a ratchet assembly operatively associated with the shaft. The second pulley assembly and the paddle assembly may be operatively associated with the shaft. The ratchet assembly may permit the second pulley assembly to rotate in a counter-clockwise direction by compression of the biasing means without rotation of the shaft to cause a rewinding of the paddle string and the pull string.

DETAILED DESCRIPTION OF THE DISCLOSURE

Figure 1:
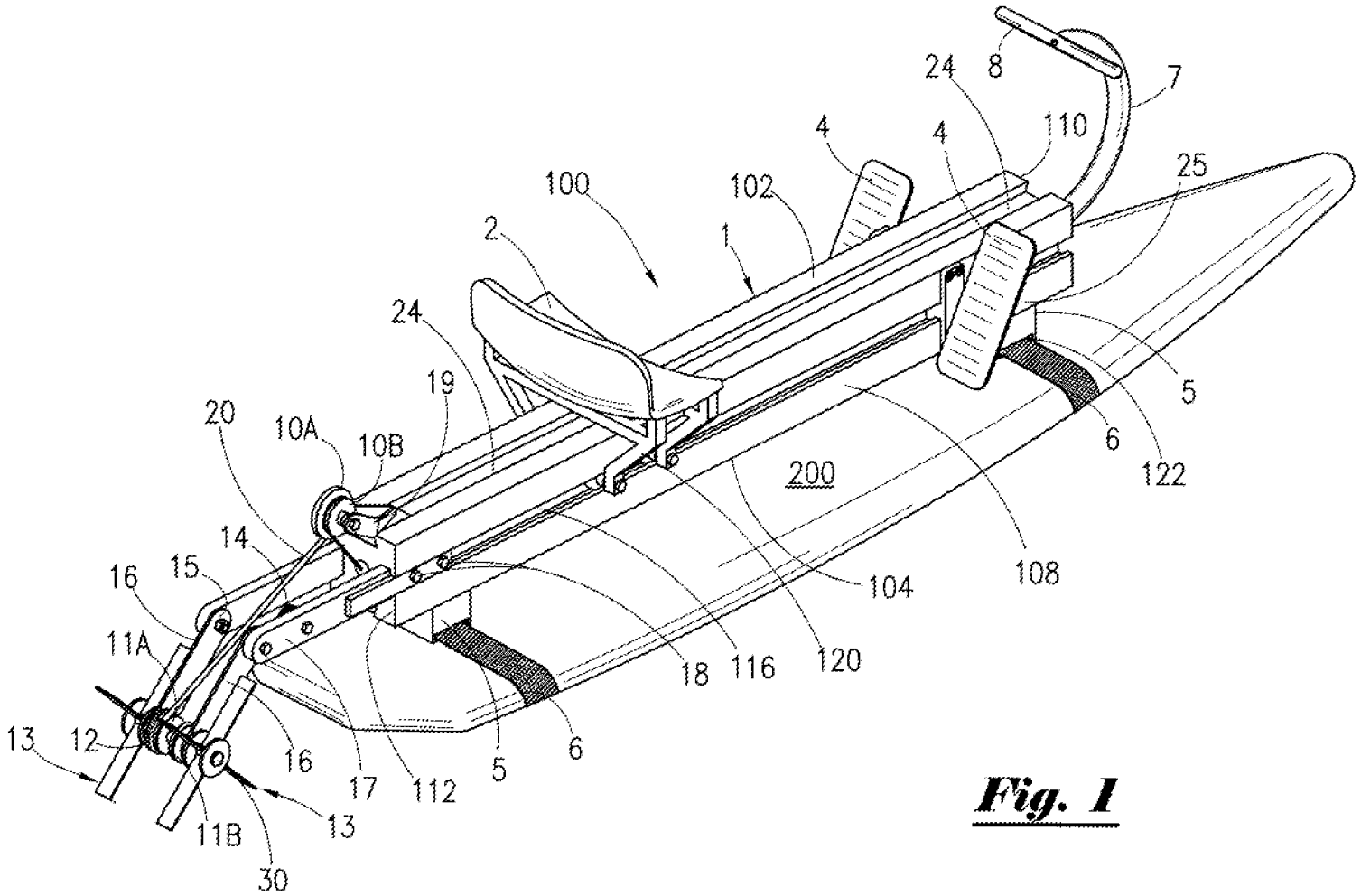
FIG. 1 is a perspective view of an embodiment of the indoor/outdoor rowing machine configured for adaptation to a watercraft.

With reference to the Figures where like elements have been given like numerical designation to facilitate an understanding of the present disclosure, and particularly with reference to the embodiment of the indoor/outdoor rowing apparatus 100 illustrated in FIGS. 1-5, apparatus 100 is shown operatively affixed to watercraft 200. It is to be understood that watercraft 200 may be any type of vessel capable of transport on a body of water. For example, watercraft 200 may be a SUP, kayak, canoe, or pirogue. Apparatus 100 may be detachably connected to watercraft 200. Apparatus 100 may include longitudinal support member 1 that acts as a main brace to permit attachment of items thereto. Member 1 may include upper side 102, bottom side 104, left side 106, and right side 108. Each of sides 106, 108 interconnect upper and bottom sides 102, 104. Member 1 may also include front end 110 and rear end 112. Member 1 may be made of aluminum or other metal. Alternatively, member 1 may be made of hardened plastic or like material.

Figure 7:
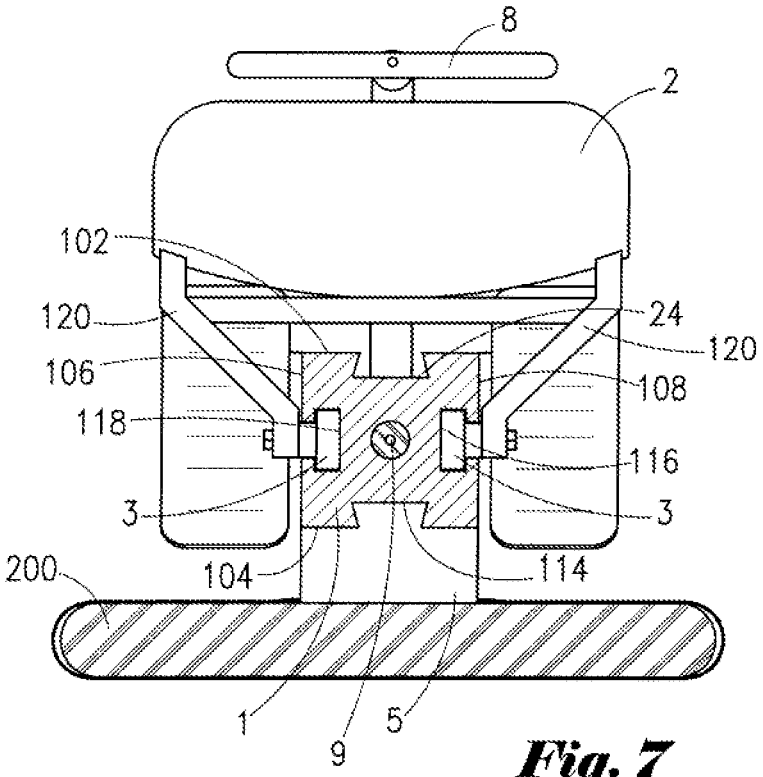
FIG. 7 is a cross-sectional view of the embodiment of the indoor/outdoor rowing machine taken along lines 7-7 of FIG. 3.

With reference to FIGS. 1-5 and 7, member 1 may include slot 24 formed by upper side 102. Slot 24 may be configured in many shapes so as to retain in sliding relationship items that may be permanently or detachably affixed to member 1. As shown in FIG. 7, slot 24 is dovetail shaped. Slot 24 may extend partially or completely along the length of member 1. Similarly, each of the bottom side 104 and left and right sides 106, 108 may include respective slots 114, 116, 118 as seen in FIG. 7.

As seen in FIGS. 1-5, apparatus 100 may include seat 2. Seat 2 may be operatively connected to member 1 in sliding arrangement. Seat 2 may be operatively positioned on or spatially above upper side 102. Seat 2 may be configured to slide partly or entirely along member 1. Seat 2 may be slidably affixed to and partially contained within slot 24. Alternatively, seat 2 may be slidably affixed to and partially contained within slots 116 and 118. For example, seat 2 may include one or more legs 120 extending downward from seat 2. Each distal end of leg 120 has wheel 3 rotationally affixed thereto. Wheel 3 may be operatively connected or positioned within one or both slots 116, 118 thereby permitting seat 2 to move in a forward and backward direction relative to member 1. Seat 2 may be configured with (i) two legs 120 and two wheels 3, with one leg 120 and one wheel assembly 3 on each of the sides of seat 2 (e.g., the left and right sides) or (ii) four legs 120 and four wheels 3, with two legs 120 and two wheel assemblies 3 on each side of seat 2 (the left and rights sides). It is to be understood that the number of legs 120 and wheels 3 and their placement about seat 2 may vary depending on operational parameters. Seat 2 may be configured to accommodate the buttocks of the rower using apparatus 100. For example, seat 2 may include an upper contoured surface profiled to accommodate the rower's buttocks when seated upon seat 2. Seat 2 may also have a back-rest. Seat 2 may be constructed of any durable material such as metal or hard plastic. Seat 2 may contain a cushioning member on its upper surface.

With reference to FIG. 1, items may be operatively connected about member 1 by fasteners 25. Fasteners 25 may interlock within slots 24, 114, 116, and/or 118. Fasteners 25 may be fixedly connected to member 1 so that the item remains stationary relative to member 1. Fasteners 25 may also be detachably connected to member 1 so that the item may be removed from or repositioned about member 1. Fasteners 25 may be configured to mate with slots 24, 114, 116 and 118 and be bolted, wedged, or otherwise fixed stationary therewithin. Fastener 25 may include a part or portion that has an outer contour configured for accommodation within the inner profile defining slots 24, 114, 116, and 118. Fasteners 25 may be constructed of any durable material such as metal or hard plastic. Fasteners 25 may contain bores through which bolts or other retaining members are placed in order to secure items via fasteners 25 to support member 1.

FIGS. 1-3 and 5 shows apparatus 100 with foot rest 4 operatively positioned on member 1. Two foot rests 4 may be provided, with one of the rests 4 operatively connected to member 1 on left side 104 (not shown) and the other rest 4 operatively connected to member 1 on right side 106. Each rest 4 may be affixed to fastener 25, which in turn is operatively positioned within respective slots 116, 118 to detachably affix rests 4 to member 1. Rests 4 are configured to receive the foot (or shoe) of the user of apparatus 100 when seated upon seat 2 during use of apparatus 100 and to provide a stationary platform from which the user may project in a rearward direction relative to member 1 by sliding on seat 2 when the user's legs are extended. The position of rests 4 about member 1 may be selectively adjusted by releasing fasteners 25, repositioning rests 4, and re-tightening fasteners 25. Foot rests 4 may be constructed of any durable material such as metal or hard plastic.

As seen in FIGS. 1-3, 5 and 7, apparatus 100 may include one or more cross braces 5 extending from the bottom side 104 of member 1. Each cross brace 5 may be configured for detachably securing to watercraft 200. Each cross brace 5 may be configured to be adjustable to affix to watercraft 200 at differing locations so that the user (the "rower") is properly located in the best position on member 1 relative to watercraft 200. The upper end of each cross brace 5 may be configured for accommodation within slot 114 of member 1 and fastened thereto by any means such as one or more fasteners 25. The lower end of each cross brace 5 may be configured with an aperture 122. Each cross brace 5 may be detachably affixed to watercraft 200 by tiedown strap 6 to hold apparatus 100 to watercraft 200 by strapping underneath watercraft 200 and passing through aperture 122. Cross braces 5 may be formed of any durable material such as metal or hard plastic. Strap 6 may be any form or type of retaining means such as a woven strap, rope, cord, and the like.

The maximum length of pull on the rowing machine handle 8 may be between the range of 30 inches to 60 inches, or approximately 48 inches.

Figure 5:
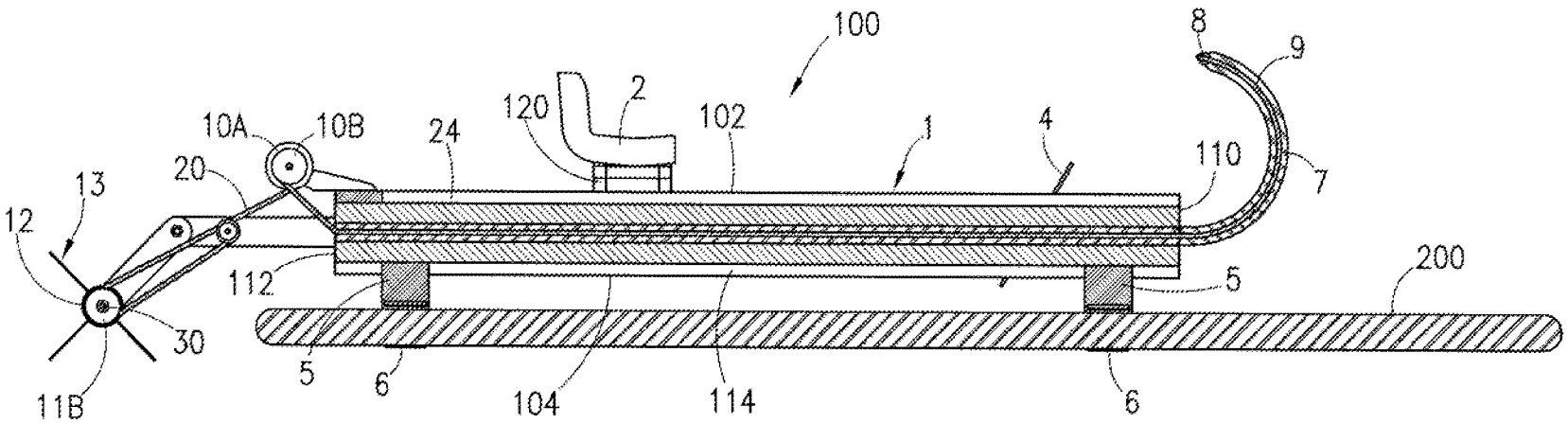
FIG. 5 is a cross-sectional view of the embodiment of the indoor/outdoor rowing machine configured for adaptation to a watercraft.

Again with reference to FIGS. 1-5, apparatus 100 may include tubing 7 operatively extending from front end 110 of member 1. Tubing 7 may be C-shaped. Tubing 7 may be used to direct the pull toward the rower for operation of apparatus 100. Tubing 7 may be lined with a material to resist abrasion and may be attached to member 1 by placement of an end portion of tubing 7 within one or both of slots 24, 114 and fastened therewithin. Handle 8 may be attached to pull rope or cord 9 (e.g., pull string 9) at its first end. Pull rope or cord 9 extends through tubing 7. The second end of pull rope or cord 9 may be attached to a first pulley assembly such as two-stage pulley 10B as seen in FIG. 5. Tubing 7 may be formed of any durable material such as metal or hard plastic. Pull string 9 may also be in the form of a length of fishing line. The fishing line may be of sufficient strength so as to operate without breaking under the stresses incurred when apparatus 100 is used. For example, the fishing line may be capable of handling 300-400 pounds of force. An example of fishing line is braided line. Tubing 7 may also be lined with a series of ceramic guides or eyes (or with a portion of a fishing rod including ceramic guides or eyes) through which pull string 9 (e.g., fishing line) extends to provide abrasion resistance.

Figure 6:
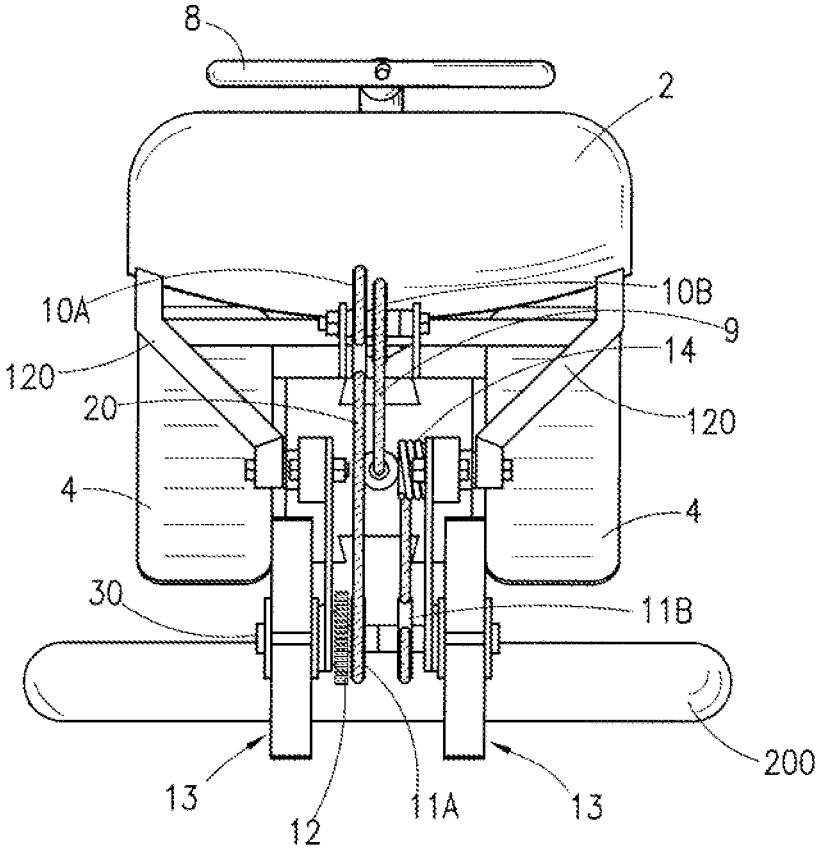
FIG. 6 is a partial rear view of the embodiment of the indoor/outdoor rowing machine configured for adaptation to a watercraft.

As illustrated in FIG. 6, the pulley assembly comprising two-stage pulley 10A, 10B may be configured to multiply the revolutions from pulley 10B to a second pulley system such as pulley 11A by approximately five times. This ratio can be varied by changing the ratio of the pulley so that the 48 inch pull will produce approximately 109 revolutions of paddle assembly per cycle. If a rower maintains a two-second cycle time, the rower would produce approximately 3272 revolutions per minute. Pulleys 10A, 10B may be made of any durable material such as metal or hard plastic.

FIG. 6 also shows second pulley assembly comprising two-stage pulley 11A, 11B. Pulley 11A is approximately five times smaller than pulley 10A so that the speed of the paddle assembly is increased by the ratio in diameter of the two opposing pulleys. Pulley 11B may be attached to wire spring 14. As the rower ends the power pull, the rower bends his/her knees and re-tracks to a start position. Spring 14 attached to pulley 11B and 11A rewinds paddle rope or cord 20 (e.g., paddle string 20) around pulley 11A. This also rewinds pull rope or cord 9 around pulley 10B. The rower is now ready for another cycle. Pulleys 11A, 11B may be made of any durable material such as metal or hard plastic. Paddle string 20 may also be in the form of fishing line.

With reference to FIGS. 1-6, apparatus 100 may include ratchet 12 so that the ropes 9, 20 can be rewound without turning pedal 4 backwards. Pulleys 11A, 11B may both be attached to shaft 30 that is attached to panel extension 17. While FIG. 6 shows separation between pulleys 11A and 11B, it is to be understood that pulleys 11A, 11B may be directly adjacent one another. Ratchet 12 may be engaged when shaft 30 turns clockwise but allows pulleys 11A, 11B to rotate counter-clockwise by means of spring 14 thereby rewinding paddle rope or cord 20 when the rower moves forward and the spring tension is greater than the slack in rope or cord 20. The rewinding of paddle rope or cord 20 also causes the rewinding of pull cord or rope 9. Paddle rope or cord 20 may be used to deliver power to paddle assembly 13 by means of pulleys 10A, 10B and pulleys 11A, 11B.

Again with reference to FIGS. 1-6, apparatus 100 may include paddle assembly 13 operatively positioned and rotatable on both sides of pulleys 11A, 11B and ratchet 12. Each paddle assembly 13 may include one or more paddles, as for example, four paddles spaced equidistant apart from each other about shaft 24. Each paddle assembly 13 may be operatively attached to shaft 30. Wire spring 14 may be attached to frame extension 17 and pulley 11B. Paddle assembly 13 may be formed of any durable material such as metal or hard plastic. The size, shape and dimensions of the paddles may vary depending on operational parameters.

As further seen in FIGS. 1-5, apparatus 100 may include adjustable bracket 15 that enables each paddle assembly 13 to be rotated up to approximately 180°. This rotation allows the paddles to be adjusted to the individual craft, such as a SUP or kayak. Adjustable bracket 15, along with bracket 16, enables apparatus 100 to be used at home by rotating paddles 90° when the paddle assemblies 13 are operatively placed in container 23 holding water or other fluid to thereby simulate rowing when apparatus 100 is configured for indoor use (use other than on watercraft 200). This adjustability allows for the user to place the rowing machine (apparatus 100) on different types of watercraft 200 and adjust the panel depth for best performance. Bracket 16 operatively attaches paddles assembly 13 to member 1 through adjustable bracket or pivoting hinge 15 via extension frames 17. Extension frames 17 allow the paddles assembly 13 to be moved closer to or farther away from rear end 112 of member 1 to adjust to the different watercrafts 200 being used. Extension frames 17 may be inserted in respective slots 116, 118 of member 1 and may be held in place by extension nut 18. Frame 19 may hold pulleys 10A, 10B to member 1 using slot 24 (or alternatively slots 116, 118). Bracket 15 and extension frames 17 may be made of any durable material such as metal or hard plastic.

Figure 8:
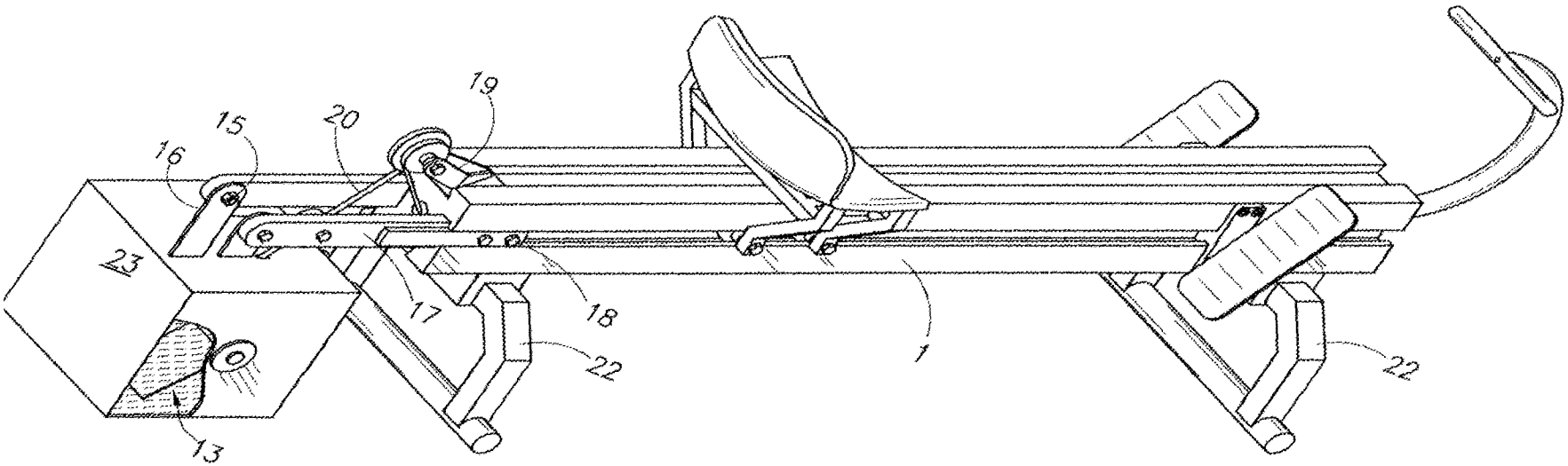
FIG. 8 is a perspective view of an embodiment of the indoor/outdoor rowing machine configured for adaptation as an indoor rowing machine.

FIG. 8 shows apparatus 100 in home or indoor mode. Support legs 22 may be inserted into cross braces 5 and bolted or fastened into place. The height allows extension arm 16 to rotate downward into container 23 so that water or fluid placed in container 23 will simulate rowing on watercraft 200. Container 23 may have a lid to prevent water or fluid from splashing out. Support legs 22 may be made of any durable material such as metal or hard plastic. Container 23 also may be made of any durable material sufficient to retain fluid therein. Such material may include metal or plastic. Cross braces 5 may be configured as a single square-shaped extension protruding downward from bottom side 104 of support member 1 and contain a recess for placement of the upper end of a support leg 22 therein. Alternatively, cross braces 5 may be configured to have L-shaped extension arms that terminate at ends configured to receive the upper end of a support leg 22. Alternatively, each support leg 22 may be made integral with respective cross-brace 5.

Figure 9:
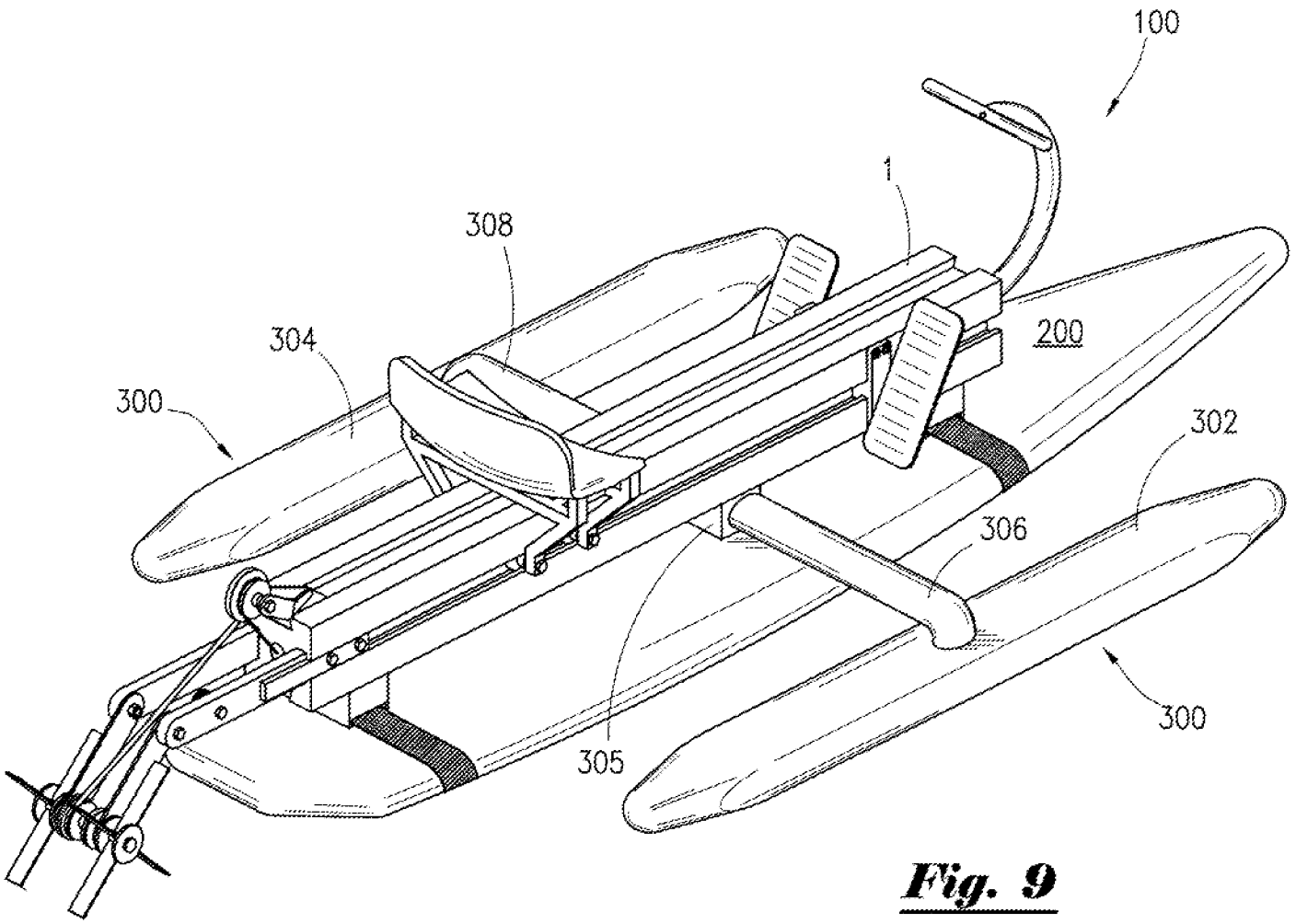
FIG. 9 is a perspective view of an embodiment of the indoor/outdoor rowing machine configured for adaptation to a watercraft with attached pontoon accessories.

As seen in FIG. 9, apparatus 100 may include one or more pontoon assemblies 300 as accessories when apparatus 100 is configured for use on watercraft 200. FIG. 9 shows apparatus 100 configured with two pontoon assemblies 300, detachably affixed to support member 1 on each of its sides (i.e., left and right sides). It is to be understood that one pontoon assembly 300 could be detachably affixed to support member 1. Pontoon assemblies 300 are designed to provide an additional stability, if necessary, when apparatus 100 is configured for adaptation to watercraft 200. Pontoon assemblies 300 may include flotation module 302, 304 that may be permanently or detachably affixed to extension arm 306, 308 at one end. The other end of extension arms 306, 308 may be permanently or detachably affixed to cross brace 305, which in turn may be detachably affixed within one of slots 114, 116, or 118 of support member 1. As for example, cross brace 305 may be detachably affixed within groove 114 of support member 1 and secured thereto by a fastening means, such as fastener 25.

Figure 2:
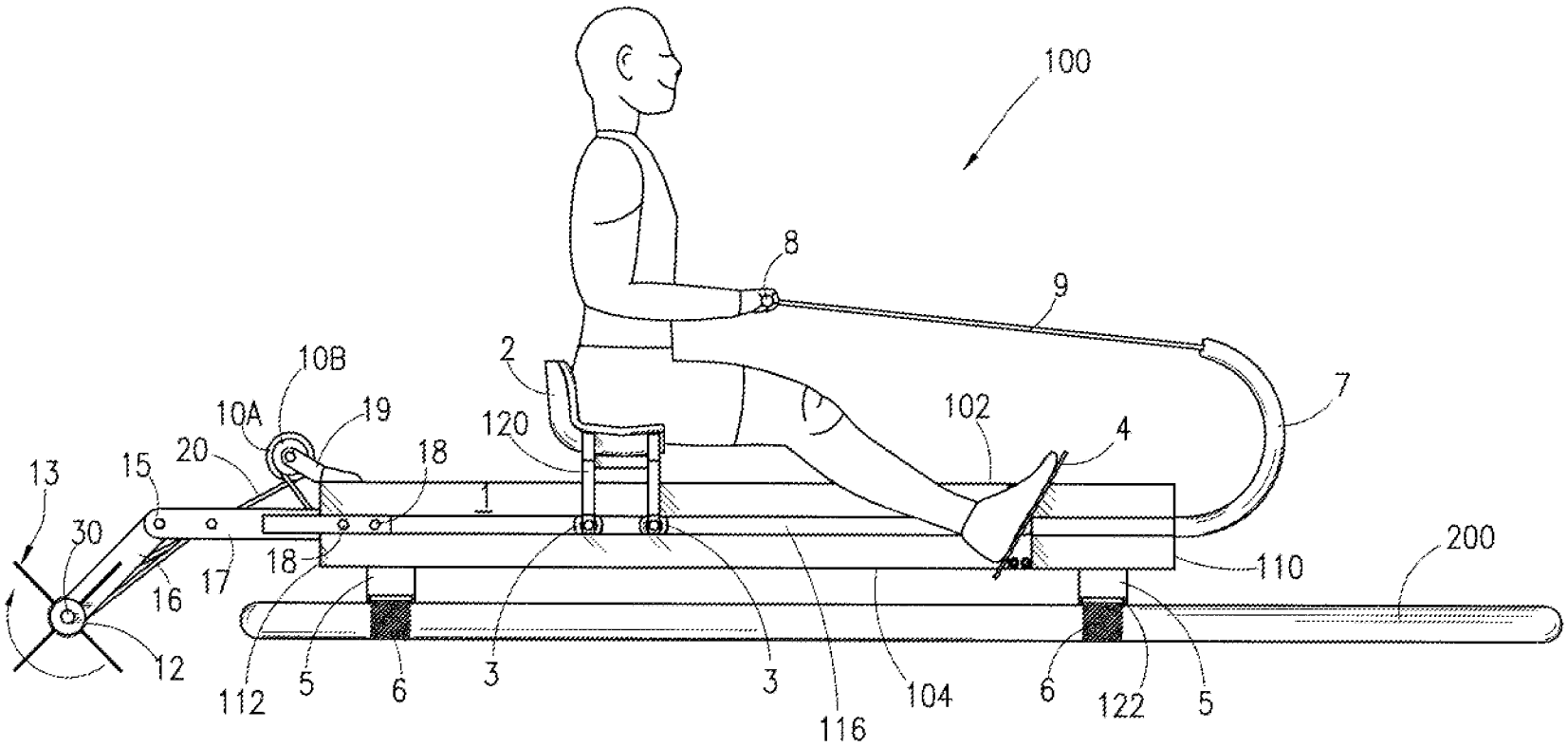
FIG. 2 is a side view of the embodiment of the indoor/outdoor rowing machine configured for adaptation to a watercraft with a rower in the extended pull position.
Figure 3:
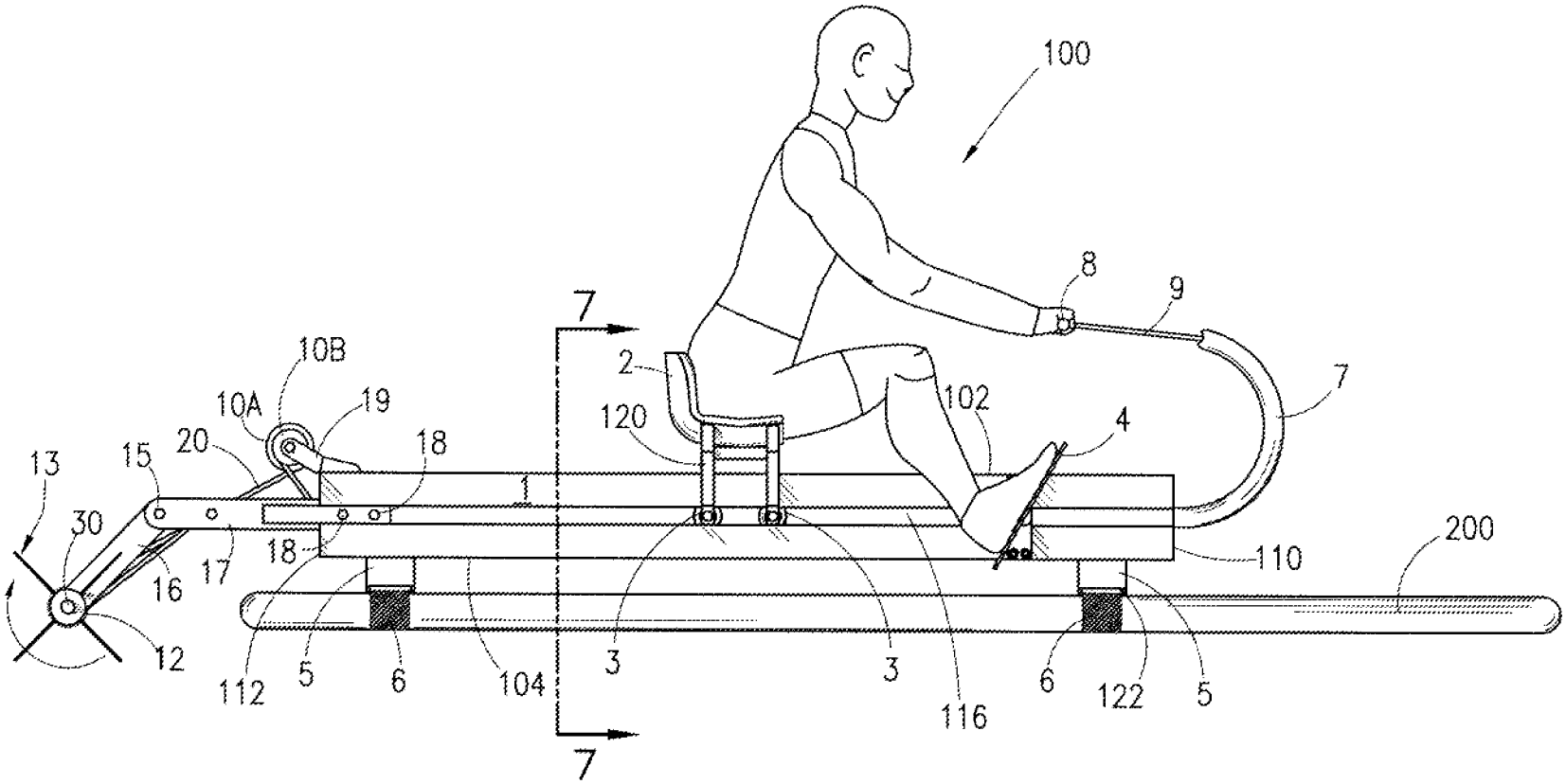
FIG. 3 is a side view of the embodiment of the indoor/outdoor rowing machine shown in FIG. 2 with the rower in the start pull position.
Figure 4:
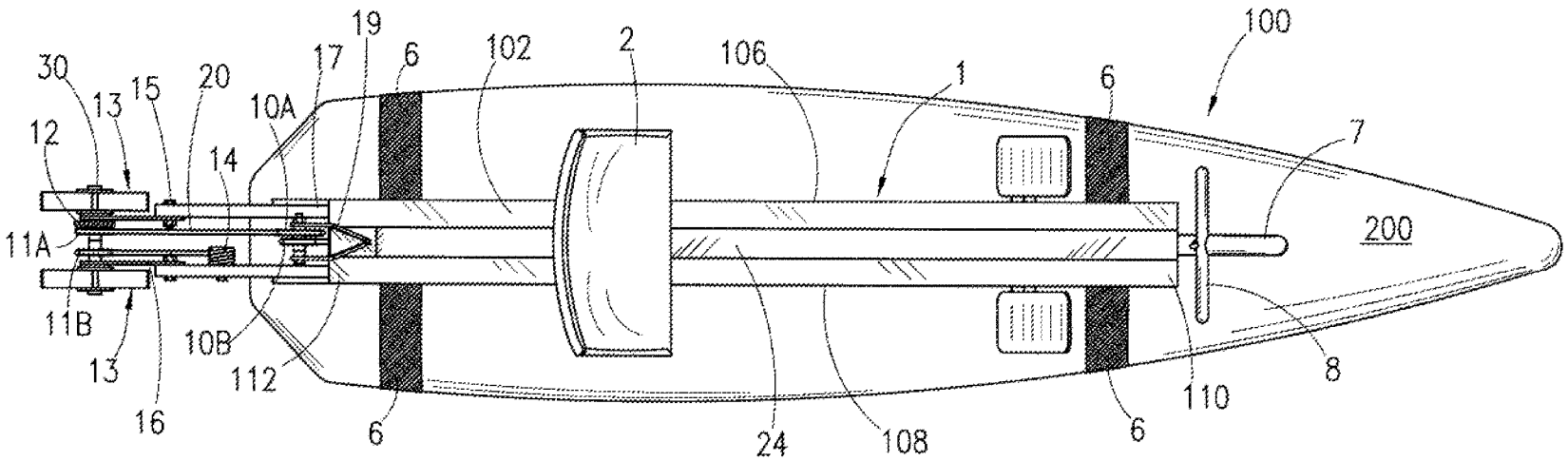
FIG. 4 is a top view of the embodiment of the indoor/outdoor rowing machine configured for adaptation to a watercraft.

To operate apparatus 100, the rower would configure apparatus 100 in either the indoor or outdoor configuration. If configured for use outdoors, the rower would connect watercraft 200 to support member 1 via cross braces 5 and straps 6 so that support member 1 is securely fixed to the upper side of watercraft 200 with front end 110 positioned at or near the front of watercraft 200 and with rear end 112 positioned at or near the rear of watercraft 200. Support member 1 should be positioned on watercraft 200 such that paddle assemblies 30 extend outward from the rear of watercraft 200 and are positioned on or within the body of water at a predetermined level. The depth of paddle assemblies 13 in the water may be set by adjustment of bracket 16 and pivoting connection of adjustable bracket 15. With the rower sitting on seat 2 as shown in FIG. 3, the rower is positioned closer to front end 110 of support member 1 with his or her knees bent and hands grasping handle 8. The rower is in the start pull position. As shown in FIG. 2, the rower has extended his legs thereby pushing his or her torso and seat 2 in a backward direction towards rear end 112 of support member 1 as well as pulling his arms closer to his torso, which cause pull string 9 to be pulled thereby causing rotation of pulley assemblies 10A, 10B, and 11A, 11B to rotate shaft 30 producing rotation of paddles assemblies 13. Rotation of paddle assemblies 13 will produce propulsion causing watercraft 200, with rower aboard, to move in a forward direction. Once full pull of pull string 9 is achieved, the rower then slides forward back into the pull start position as shown in FIG. 3. The slack created in pull string 9 is taken up by operation of ratchet 12 and spring 14. The rower can then engage in another rowing motion to move watercraft 200 forward by rotation of paddle assemblies 13 as discussed above.

After use in the outdoor mode, the rower may convert apparatus 100 for indoor use by removing watercraft 200 from support member 1 and attaching support legs 22 as shown in FIG. 8. The rower would also place paddle assemblies 13 within container 23 that holds water or other fluid in order to provide resistance during the rowing operation. In the indoor configuration, the rower undertakes the same rowing motion as discussed above.

The rower can vary the resistance of the rowing force necessary to rotate paddles 300 in a variety of ways. For example, the rower may change the length and width of the paddles comprising paddle assemblies 13 and use a short or narrow paddle, which will change stroke efficiencies. In the indoor mode, the rower can add less or more water or fluid to container 23 in order to also vary resistance.

While preferred embodiments of the present disclosure have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A rowing apparatus comprising:

a longitudinal support member having a front end, a rear end, an upper side, a bottom side, a first side interconnecting the upper and bottom sides, and a second side interconnecting the upper and bottom sides;

a seat operatively affixed to the longitudinal support member and configured for sliding movement along a length of the longitudinal support member;

a foot rest assembly adjustably affixed to the longitudinal support member;

a tubular member having first and second ends, the first end operatively affixed to the front end of the longitudinal support member, the second end terminating above the longitudinal support member, a first pulley assembly operatively connected to the rear end of the longitudinal support member;

a second pulley assembly operatively connected by a second pulley frame assembly to the rear end of the longitudinal support member;

a paddle assembly rotationally positioned on a shaft and operatively associated with the second pulley assembly;

a pull string having a first end external to the second end of the tubular member and connected to a handle, the pull string extending through the tubular member with the second end operatively connected to the first pulley assembly;

a paddle string having a first end operatively connected to the second pulley assembly and a second end operatively connected to a biasing means; and one or more mounting brackets extending from the bottom side of the support member, the one or more mounting brackets configured for attachment to a watercraft for use of the rowing apparatus on a body of water or to one or more support legs for use of the rowing apparatus on a rigid surface.

2. The rowing apparatus of claim 1, wherein the longitudinal support member includes one or more slots configured for attachment of items.

3. The rowing apparatus of claim 2, wherein the one or more slots extend the length of the longitudinal support member.

4. The rowing apparatus of claim 3, wherein the one or more slots comprises a first slot formed in the upper side of the longitudinal support member.

5. The rowing apparatus of claim 4, wherein the one or more slots further comprises a second slot formed in the bottom side of the longitudinal support member.

6. The rowing apparatus of claim 5, wherein the one or more slots further comprises a third slot formed in the first side of the longitudinal support member.

7. A The rowing apparatus of claim 6, wherein the one or more slots further comprises a fourth slot formed in the second side of the longitudinal support member.

8. The rowing apparatus of claim 2, wherein the one or more mounting brackets include an aperture through which a mounting strap extends for attachment of the watercraft.

9. The rowing apparatus of claim 8, wherein the one or more slots comprises a first slot formed in the bottom side of the longitudinal support member, wherein each of the one or more mounting brackets has an upper end and a lower end, the lower end including the aperture, the upper end being operatively affixed within the first slot.

10. The rowing apparatus of claim 9, wherein the one or more mounting brackets comprises a first mounting bracket operatively positioned at the front end of the longitudinal support member and a second mounting bracket operatively positioned at the rear end of the longitudinal support member.

11. The rowing apparatus of claim 10, further comprising the watercraft operatively connected to the apparatus via a securing of a first mounting strap wrapped around the watercraft and extending through the aperture of the first mounting bracket and of a second mounting strap wrapped around the watercraft and extending through the aperture of the second mounting bracket.

12. The rowing apparatus of claim 11, further comprising one or more pontoon assemblies detachably connected to the longitudinal support member on either or both of the first and second sides thereof.

13. The rowing apparatus of claim 2, wherein the seat includes one or more wheels operatively associated within the one or more slots of the longitudinal support member.

14. The apparatus of claim 13, wherein the seat includes one or more legs extending from an underside of the seat, each of the one or more legs including a distal end, and wherein each of the one or more wheels is operatively connected to the distal end of a respective one of the one or more legs.

15. The rowing apparatus of claim 2 wherein the second pulley frame assembly comprises a first frame and a second frame, each of the first and second frames having a proximal end operatively connected to the second pulley assembly and a distal end, wherein the one or more slots comprises a first slot formed in the first side of the longitudinal support member and a second slot formed in the second side of the longitudinal support member, and wherein the distal end of the first frame is operatively affixed within the first slot and the distal end of the second frame is operatively affixed within the second slot.

16. The rowing apparatus of claim 15, wherein the first frame comprises a first section and a second section, the first section having a distal end operatively affixed within the first slot and a proximal end operatively connected to a first pivoting hinge, the second section having a proximal end operatively connected to the first pivoting hinge and a distal end operatively connected to the second pulley assembly; wherein the second frame comprises a first section and a second section, the first section having a distal end operatively affixed within the second slot and a proximal end operatively connected to a second pivoting hinge, the second section having a proximal end operatively connected to the second pivoting hinge and a distal end operatively connected to the second pulley assembly.

17. The rowing apparatus of claim 2, wherein the one or more slots each has a dove-tail shape.

18. The rowing apparatus of claim 2, wherein the foot rest assembly comprises a first platform and a second platform, wherein the one or more slots comprises a first slot formed in the first side of the longitudinal support member and a second slot formed in the second side of the longitudinal support member, and wherein the first platform is operatively affixed within the first slot and the second platform is operatively affixed within the second slot.

19. The rowing apparatus of claim 2, wherein the one or more slots comprises a first slot formed in the upper side of the longitudinal support member, wherein the first pulley assembly includes a first pulley frame having a proximal end operatively affixed to the first pulley assembly and a distal end operatively connected within the first slot.

20. The rowing apparatus of claim 1, wherein the one or more mounting brackets comprise first and second mounting brackets each configured as a cross brace, the first cross brace is operatively positioned at the front end of the longitudinal support member and the second cross brace is operatively positioned at the rear end of the longitudinal support member, each of the first and second cross braces including one or more recesses configured for placement of an upper end of a leg.

21. The rowing apparatus of claim 20, further comprising the one or more support legs having an upper end and a lower end, the upper end of each of the one or more support legs being received within one of the one or more recesses of the first and second cross braces, and the lower end of each of the one or more support legs being support by the rigid surface.

22. The rowing apparatus of claim 21, further comprising a container having an interior, the interior filled with a fluid, wherein the paddle assembly is operatively positioned within the interior of the container.

23. The rowing apparatus of claim 22, wherein the container has a removable lid.

24. The rowing apparatus of claim 22, wherein the paddle assembly comprises a plurality of interchangeable paddle vanes, and wherein the size or shape of the plurality of interchangeable paddle vanes results in a variable resistance when the plurality of interchangeable paddle vanes are rotated in the fluid.

25. The rowing apparatus of claim 22, wherein the amount of fluid within the interior of the container provides a variable resistance to the paddle assembly when rotated.

26. The rowing apparatus of claim 1, wherein the first pulley assembly is a two-stage pulley system comprising a first pulley and a second pulley in operative arrangement, the first pulley having a reduced diameter relative to the second pulley.

27. The rowing apparatus of claim 1, wherein the second pulley assembly is a two-stage pulley system comprising a first pulley and a second pulley in operative arrangement, the first pulley having a reduced diameter relative to the second pulley.

28. The rowing apparatus of claim 1, wherein the paddle assembly includes a plurality of paddle vanes.

29. The rowing apparatus of claim 1, wherein the biasing means comprises a wire spring.

30. The rowing apparatus of claim 1, further comprising a shaft and a ratchet assembly operatively associated with the shaft, wherein the second pulley assembly and the paddle assembly are operatively associated with the shaft, wherein the ratchet assembly permits the second pulley assembly to rotate in a counter-clockwise direction by compression of the biasing means without rotation of the shaft to cause a rewinding of the paddle string and the pull string.

* * * * *